United States Patent [19]

Grassi et al.

[11] Patent Number: 4,920,909

[45] Date of Patent: May 1, 1990

[54] BOAT WITH ROTATABLE WHEEL KEEL FOR RESISTANCE TO LEEWARD MOVEMENT IN WATER AND FOR SAND TRANSPORT

[76] Inventors: David Grassi, 675 A Castro St., San Francisco, Calif. 94114; James K. Antrim, 4018 Archery Way, El Sobrante, Calif. 94803

[21] Appl. No.: 63,777

[22] Filed: Jun. 17, 1987

Related U.S. Application Data

[63] Continuation of Ser. No. 812,295, Dec. 23, 1985, abandoned.

[51] Int. Cl.[5] ..... B63C 13/00

[52] U.S. Cl. ..... 114/344; 114/343

[58] Field of Search ..... 114/343, 344, 140, 141, 114/127, 130, 138

[56] References Cited

U.S. PATENT DOCUMENTS

| | | | |
|---|---|---|---|
| 2,283,648 | 5/1942 | Samdahl | 114/344 |
| 2,477,425 | 7/1949 | Seaholm | 114/140 |
| 2,617,139 | 11/1952 | Bittel | 114/344 |
| 3,599,256 | 8/1971 | Carroll, Jr. | 114/344 |
| 3,755,835 | 9/1973 | Botersig | 114/344 |
| 4,235,450 | 11/1980 | Conover | 114/344 |

FOREIGN PATENT DOCUMENTS

| | | | |
|---|---|---|---|
| 257604 | 5/1963 | Australia | 114/344 |
| 334508 | 11/1958 | France | 114/344 |
| 1580375 | 9/1969 | France | 114/344 |

*Primary Examiner*—Joseph F. Peters, Jr.
*Assistant Examiner*—Clifford T. Bartz

[57] ABSTRACT

A rotatable wheel is mounted under a sailboat or other boat and shaped in a manner such that it will be efficient in developing a hydrodynamic lifting force to function as the boat's primary keel to resist leeway and provide directional stability. The wheel or wheels can also be used to ramp launch or haul the boat and to roll the boat about on land. In order to reduce hydrodynamic drag, a tire fitted onto the wheel forms a continuous and fair surface with the wheel wall.

5 Claims, 2 Drawing Sheets

BOAT WITH ROTATABLE WHEEL KEEL FOR RESISTANCE TO LEEWARD MOVEMENT IN WATER AND FOR SAND TRANSPORT

This is a continuation of application Ser. Nr. 812,295, filed 12-23-1985 now abandoned.

BACKGROUND

1. Field of Invention

The invention relates to the new use of a wheel as a keel for a sailboat to resist leeward movement in water and for transportation of boats over land.

2. Description of Prior Art

Prior devices for ramp launching of boats include trailers and other wheeled devices. Such devices normally would be detached at water's edge, and thereby create a storage and security problem while the boat is in use on the water. Some small vessels have permanently mounted wheels for ramp launching, which, due to their unstreamlined design, create tremendous undesirable drag when the vessel is moving through the water.

A sailboat must have a keel or similar device (i.e. centerboard, bilgeboards, or leeboards) to resist leeway when sailing upwind. In order to serve this function, the keel must be streamlined to minimize drag against forward motion; yet shaped to effectively resist leeward motion. This requires a keel with a small frontal area, a hydrodynamically smooth and fair surface in the direction of motion, and relatively large transverse projected area. A keel is also used on other types of boats to aid in directional stability. Heretofore this device was always separate from the wheeled device used for launching.

A user of such a boat has to roll the boat into the water, float the boat off the trailer or detach or retract the rolling device, tie off the boat while such user runs up to store the trailer, return to the boat, lower the centerboard, and finally sail away. Haul out is a reversal of these steps.

Therefore, a user would appreciate a device which would allow such user to roll the boat directly into the water and sail away without having to perform the above complex and tedious procedure.

OBJECTS AND ADVANTAGES

Accordingly, we assert the following objects and advantages of our invention: the provision of a boat with a keel which is sized and shaped to be hydrodynamically efficient in resisting leeway, yet which has greatly improved ease of launching and haul out, and elimination of the security risk of a trailer left on shore. Other objects and advantages are to provide a boat with reduced drag for greater speed in the water, reduced risk of damage due to grounding, easier rolling on land, and the potential for rolling over the bottom in shallow water where other boats might get stuck.

Readers will find further objects and advantages of the invention from a consideration of the ensuing description and the accompanying drawings.

DRAWING FIGURES

DRAWING REFERENCE NUMERALS

Figure 1:
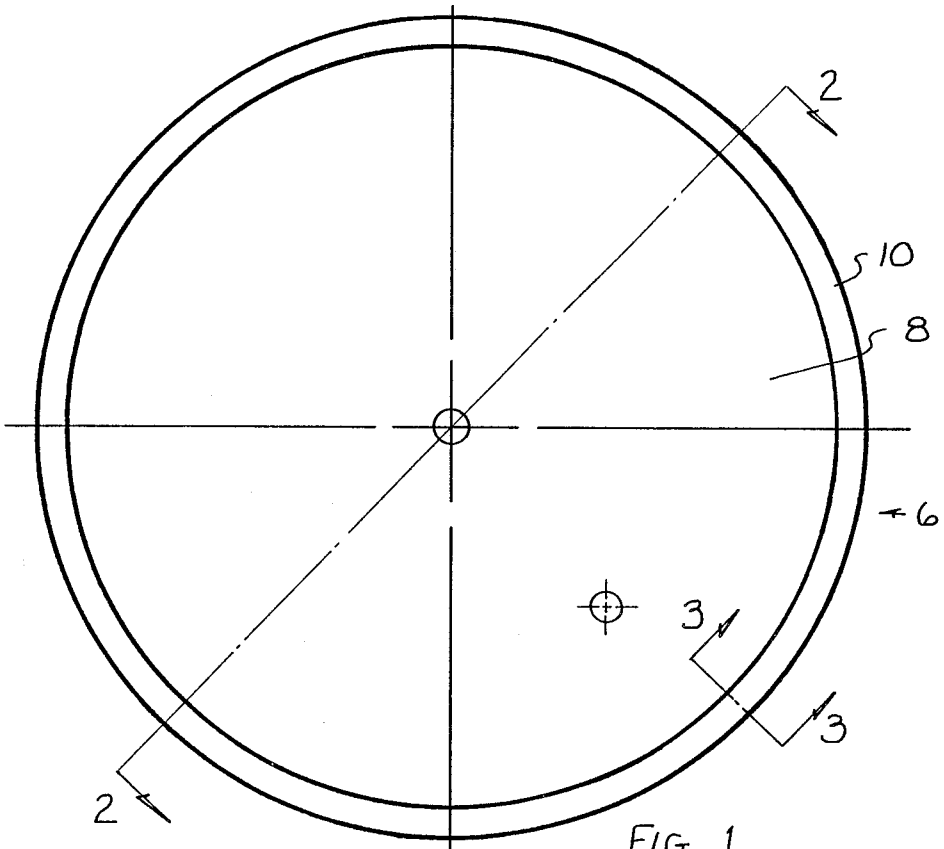
FIG. 1 shows a profile view of a combined wheel and the tire used in the invention.

6 wheel and tire
8 side wall of wheel
10 tire
12 axle
14 hull
16 rudder

WHEEL SHAPED KEEL—DESCRIPTION

In accordance with our invention, we provide a boat with a keel which is in the form of a wheel, which is rotatably mounted, and which is hydrodynamically shaped for stabilizing the boat in water and enabling it to travel easily over land.

Figure 5:
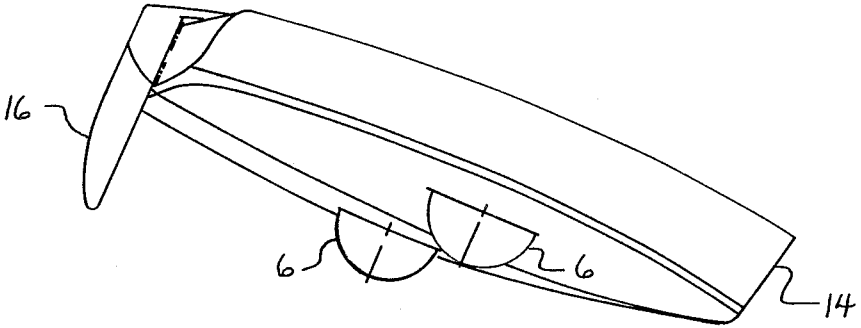
FIG. 5 shows a perspective view of wheels mounted to the hull of a monohull boat in another embodiment of the invention.
Figure 4:
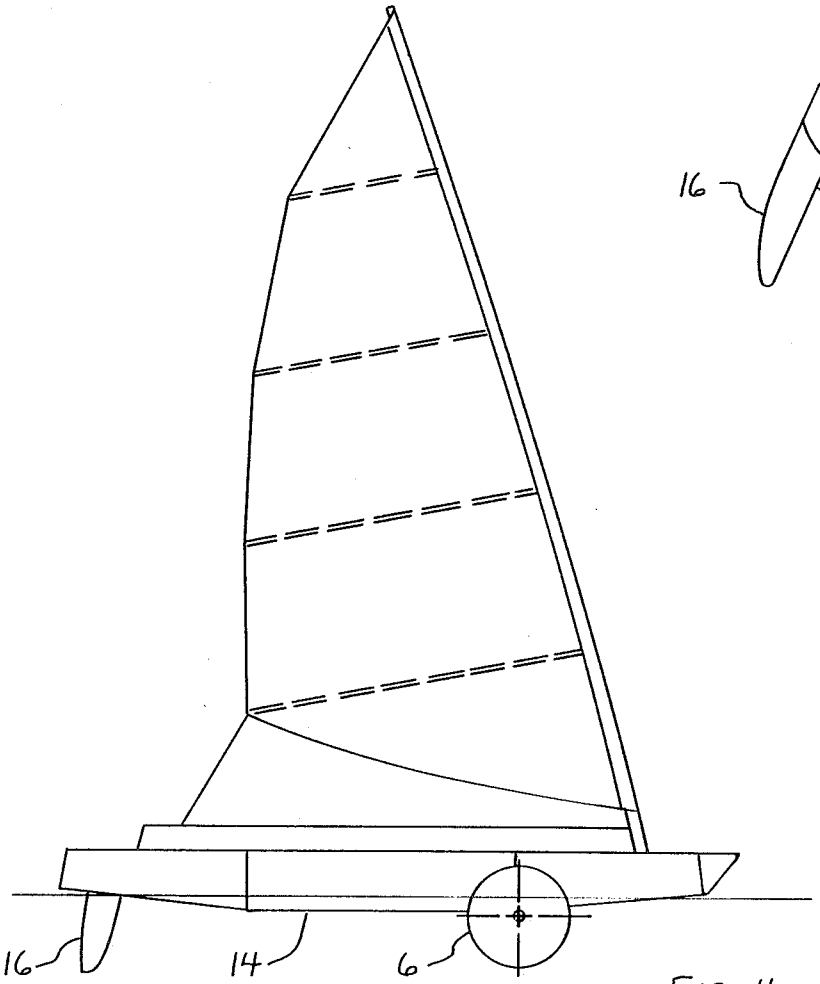
FIG. 4 shows a profile view of an inflatable catamaran sailboat with a wheel mounted according to the invention

FIGS. 4 and 5 show boats with wheels as they might be mounted on a sailboat in place of a conventional keel. Two wheels would be normally mounted, either alongside the hull(s) 14 as in FIG. 4 or recessed into the hull 14 as in FIG. 5. The wheels are mounted such that axle 12 is recessed into the hull 14 or projects minimally into the water when the sailboat is afloat. Wheels 6 in FIG. 5 have less than fifty percent of their diameter projecting into the water, and wheel 6 in FIG. 4 has seventy percent of its diameter projecting into the water.

Figure 2:
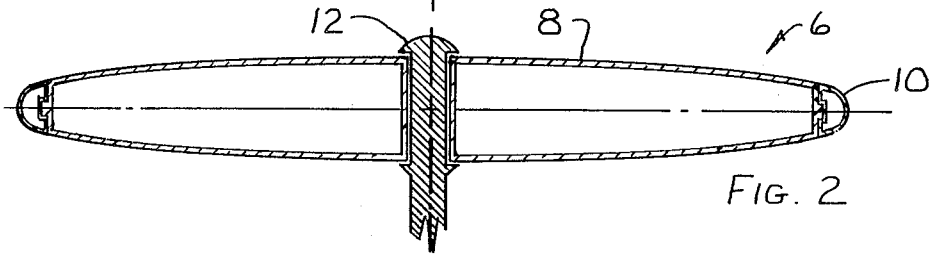
FIG. 2 shows a section through the wheel and tire having a transverse width to diameter ratio of 0.125.
Figure 3:
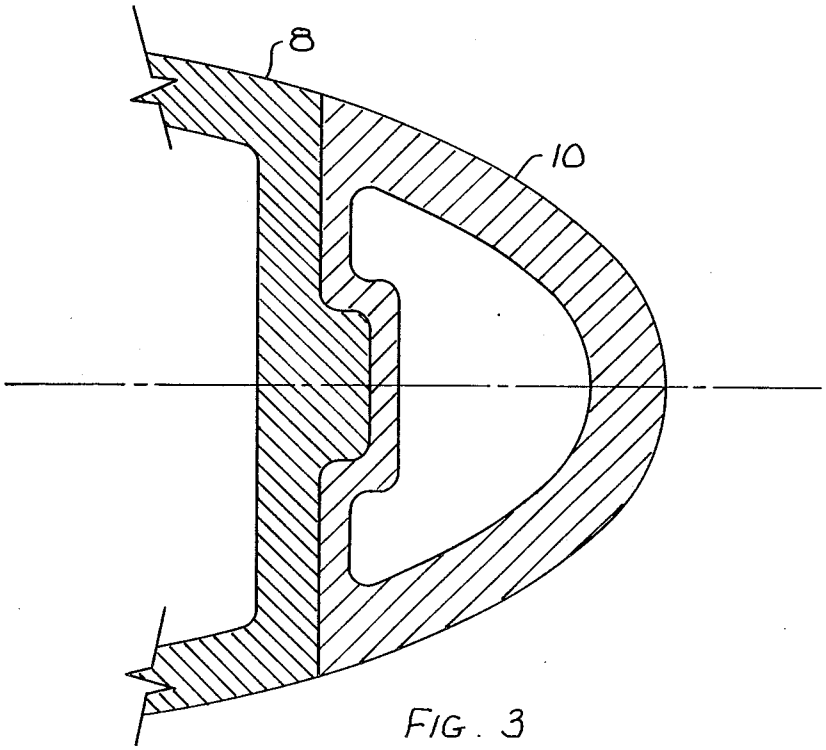
FIG. 3 shows an enlarged section through the tire and periphery of the wheel detailing the junction of said wheel and tire.

The wheel side wall 8 is a solid and continuous surface, and as shown in FIG. 3, fits flush and tangent with the exposed surface of a tire 10 which is mounted on the perimeter (rim or circumferential edge) of sidewall 8. As shown in FIG. 2, a radial section through wheel and tire 6 from axle 12 to perimeter is shaped like a narrow ellipse divided at its minor axis or like the forward portion of a symmetrical wing section with the maximum thickness of the wing section being at axle 12. The mathematical curve describing the outside surface of this sectional shape is a mathematically smooth and continuous curve, with no abrupt changes in radius of curvature. The curve is parallel to axle 12 at the perimeter; and perpendicular to axle 12 at the axle. Maximum thickness of wheel 6 is at axle 12 and the ratio of thickness to wheel diameter is $\frac{1}{8}$.

WHEEL SHAPED KEEL—OPERATION

A sailboat with wheels mounted as shown in FIGS. 4 and 5 can be easily rolled about on land; or when a launching ramp is available can be rolled directly into the water. With the wheel keels, the usual step of removing wheels and lowering centerboard or other keel device is eliminated. The vessel may be sailed directly away from the ramp without adjustment.

The vessel will be able to sail upwind with no keel other than wheel 6 to develop necessary sideforce. The high ratio of hydrodynamic lift to drag, or of sideforce to resistance, required of upwind sailing are achievable due to three factors unique to this new wheel shape. First, wheel 6 has a low ratio of transverse width to diameter and of projected frontal area exposed to the water flow to transverse projected area. Second, the surface shape is mathematically smooth and continuous, with no abrupt change of radius of curvature. Third, because no more than seventy percent of the diameter of wheel 6 projects into the water, axle 12 and hence any attendant mounting apparatus is recessed into the hull or projects minimally into the water. Consequently there is little or no parasitic drag due to the mounting apparatus.

Under sail wheels 6 may spin in the water. We believe this action will reduce frictional boundary layer drag relative to a conventional keel or leeboard. This is, because the surface of wheel 6 will move through the water at a rate less than the speed of the boat.

When the user has completed sailing, the vessel may be rolled directly out of the water on its wheels 6. If the boat becomes grounded in shallow water, or hits a submerged rock or the like, its keel wheels will enable it to roll over the bottom or the obstacle without damage to its keel or hull, thereby avoiding the damage which would occur to a boat with a conventional rigid keel.

SUMMARY, RAMIFICATIONS, AND SCOPE

While the above description and accompanying drawings contain many specificities, the reader should not construe these as limitations on the scope of the invention, but merely as exemplification of the preferred embodiment thereof. For example, a vessel might have only one wheel on centerline, or might use a wheel as a rudder for steering purposes such that a three point suspension gives full stability on land. A hole may be made through the wheel wall for the purpose of locking the wheel against rolling or for some other purpose. The wheel rim section might be elliptical in cross section, with the center area of the wheel largely open. The use of a wheel shaped keel need not be restricted to sailboats, but can be used on any floating craft which has a need for rolling ability on land and directional stability in the water.

Accordingly the reader is requested to determine the scope of the invention by the appended claims and their legal equivalents, and not by the examples which have been given.

We claim:

1. In a boat of the type having a hull and a keel aligned with the direction of forward movement of said boat and projecting into the water to resist leeward movement of said boat in the water and to minimize resistance to forward movement of said boat in said water, said keel is a wheel which is round in perimeter when viewed from the side of said boat and in line with the axis of rotation of said wheel, said boat contains means for rotatably mounting said wheel so that it can rotate in a vertical plane parallel to the direction of elongation of said boat, and for holding said wheel in said projecting-down position when said boat is in the water, said wheel has faired, substantially smooth, solid, and continuous side surfaces except for a hole through the wheel wall, the shape of said surface, as defined by a radial section in the plane of said axis of rotation of said wheel and passing through said axis and any point on the perimeter of said wheel, is a smooth and continuous curve with no abrupt change of radius of curvature.

2. The boat of claim 1 wherein said radial section shape is perpendicular to said axis at said intersection between said shape and said axis and parallel to said axis at said perimeter.

3. The boat of claim 2 wherein said radial section shape is an ellipse.

4. The boat of claim 1, further including an additional wheel or wheels, shaped and mounted similar to said first-named wheel.

5. The invention of claim 4 wherein said boat is a sailboat capable of upwind sailing and including no keel or hydrodynamic lifting surface other than said wheel or wheels and a rudder or steering mechanism.

* * * * *